US006474944B1

(12) United States Patent
Kirby, III et al.

(10) Patent No.: US 6,474,944 B1
(45) Date of Patent: Nov. 5, 2002

(54) HOLLOW NOZZLE PARTITION WITH RECESSED END CAPS

(75) Inventors: George Horner Kirby, III, Charlton, NY (US); Mark Arne Florin, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/845,252

(22) Filed: May 1, 2001

(51) Int. Cl.[7] ..... F10D 9/04
(52) U.S. Cl. ..... 415/191; 416/233
(58) Field of Search ..... 415/191, 200, 415/209.3, 209.4, 210.1, 208.2; 416/97 R, 224, 229 A, 232, 233, 241 A

(56) References Cited

U.S. PATENT DOCUMENTS 3,166,295 A * 1/1965 Szewalski et al. ..... 29/889.21
3,315,941 A * 4/1967 Davies ..... 415/178
3,635,587 A * 1/1972 Giesman et al. ..... 29/889.721
5,269,058 A * 12/1993 Wiggs et al. ..... 228/157
6,193,465 B1 * 2/2001 Liotta et al. ..... 29/889.722

* cited by examiner

*Primary Examiner*—Edward K. Look
*Assistant Examiner*—Igor Kershteyn
(74) *Attorney, Agent, or Firm*—Nixon & Vanderhye PC

(57) ABSTRACT

A welded hollow partition formed from sheet metal and having a concave side and a convex side, includes end caps to close off the partition cavity. The end caps are recessed into the hollow partition to provide wall strengthening within the hollow partition. Epoxy or other water resistant material can be used adjacent to the end cap and within the partition. A gasket can also be fitted adjacent to the end cap and within the partition to provide a water resistant seal. The hollow partition can be filled with temperature resistant material to further seal the partition against moisture.

16 Claims, 2 Drawing Sheets

HOLLOW NOZZLE PARTITION WITH RECESSED END CAPS

BACKGROUND OF THE INVENTION

Invention relates to a hollow nozzle partition used in, for example, a boiling water reactor (BWR) environment, and, more particularly to a hollow partition with welded end caps to prevent mass transfer (i.e. water leakage, contamination) into the hollow cavity which could cause wall buckling or ballooning under certain operating conditions.

Hollow nozzle partition designs are used in fossil-fueled steam generating plants and reach lengths of at least 33.5". As shown in FIG. 1, a hollow nozzle partition is formed from two curved metal plates, a convex plate 10 and concave plate 12, joined along their seams 14, 16, typically, by welding. End cap 11 may be welded at one (or both open ends) to form an enclosed hollow nozzle partition. Only one end cap 11 is needed where the other open end is closed off by attachment of the hollow nozzle partition to a turbine ring or the like.

Pressurized water reactor (PWR) nuclear power plants also currently use hollow nozzle partitions. The hollow nozzle partitions provide substantial cost savings versus solid partitions in nuclear, low-pressure, environments where partition lengths reach roughly between 38" and 52".

When hollow nozzle partitions are welded or attached by other means to either or both of the inner and outer rings of a turbine they act as a quasi-pressure vessel. If any moisture leaks into the hollow nozzle partition through a weld or other point of porosity, the water flashes to steam, upon reaching a critical temperature, and creates enough pressure to yield the sidewall of the partition. This type of partition failure mode has been termed "ballooning" and is preceded by wall buckling.

Although solid partitions do not encounter ballooning and wall buckling failure modes and therefore do not experience this problem the cost savings associated with hollow partitions make it desirable to solve these problems. The previous designs that utilized hollow nozzle partitions in fossil-fueled steam generator plants also encountered these failure modes. The conventional solution to this problem has been to drill two ¼" diameter holes 18 in the sidewall of the partition (one on each end), to allow the partition to vent, as shown in FIG. 1.

Nuclear units are intrinsically wet environments where relative humidity can reach 11% or higher at the last stage diaphragm in the low-pressure section. A result of this moisture running through the unit is increased erosion of the steel components, thus causing small particulates to travel along the steam path. In a BWR (boiling water reactor) power plant, water passes and comes in contact with the reactor core (this is opposed to a PWR unit where the water is contained within piping and does not come into contact with the core). Any suspended solids due to erosion will become irradiated by the reactor core and will thus be carried by the steam throughout the turbine.

Once these irradiated particles become lodged in small cracks, holes and crevices, they create "hot" spots of radiation contamination. This contamination needs to be avoided during outages where componentry is cleaned and repaired because of adverse biological effects to the workers. Accordingly, the conventional solution cannot be used in nuclear units and is especially not suitable in a BWR environment.

BRIEF SUMMARY OF THE INVENTION

The above described problems of the prior art are solved by the invention which incorporates a recessed end cap welded or bonded onto at least one end of the hollow nozzle partition. The recessed end cap prevents wall buckling and ballooning failure modes by preventing contamination and moisture from accumulating within the hollow cavity.

DETAILED DESCRIPTION OF THE INVENTION

Figure 1:
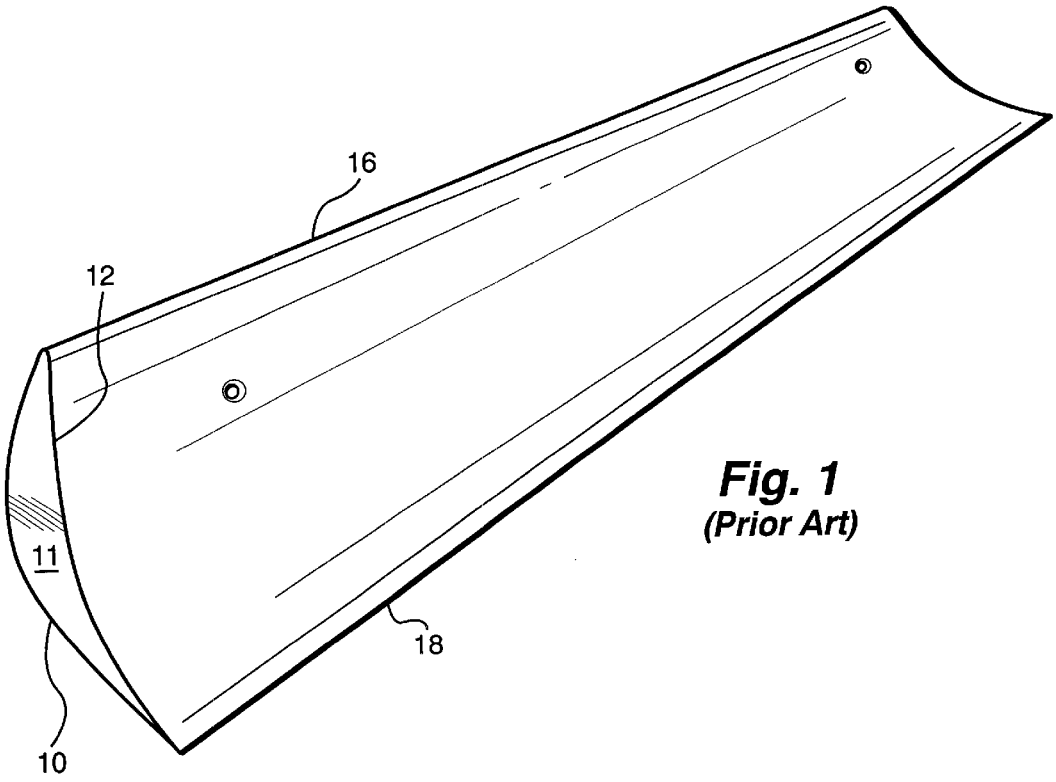
Fig. 1 (Prior Art)
FIG. 1 is a conventional prior art hollow partition with vent holes.
Figure 2:
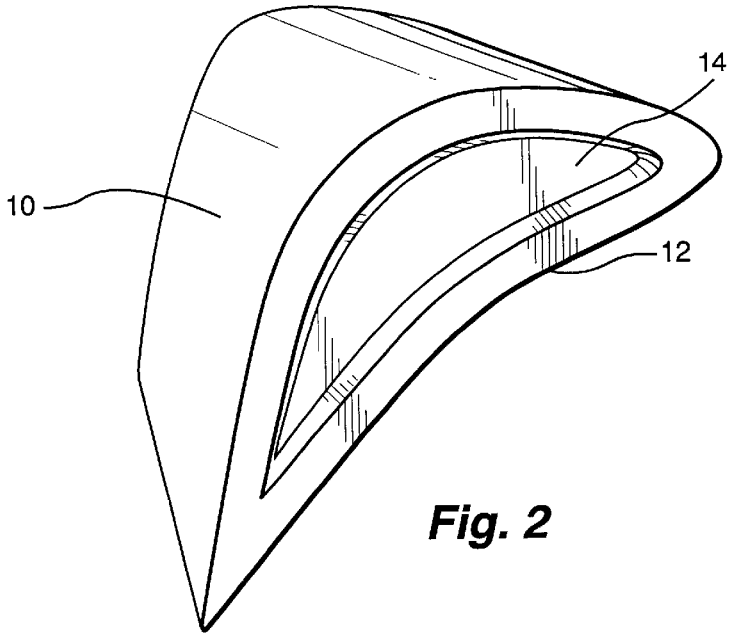
FIG. 2 is a perspective view of an exemplary embodiment of the present invention.

As shown in FIG. 2, the invention comprises convex half partition 10 and concave half partition 12 which are formed out of sheet metal, then welded along the two seams and machined to the final shape. Recessed end cap 14 is then welded or bonded into the open end of the formed hollow partition. The welding or bonding process should be validated through testing to consistently provide leak-proof seals.

Figure 3:
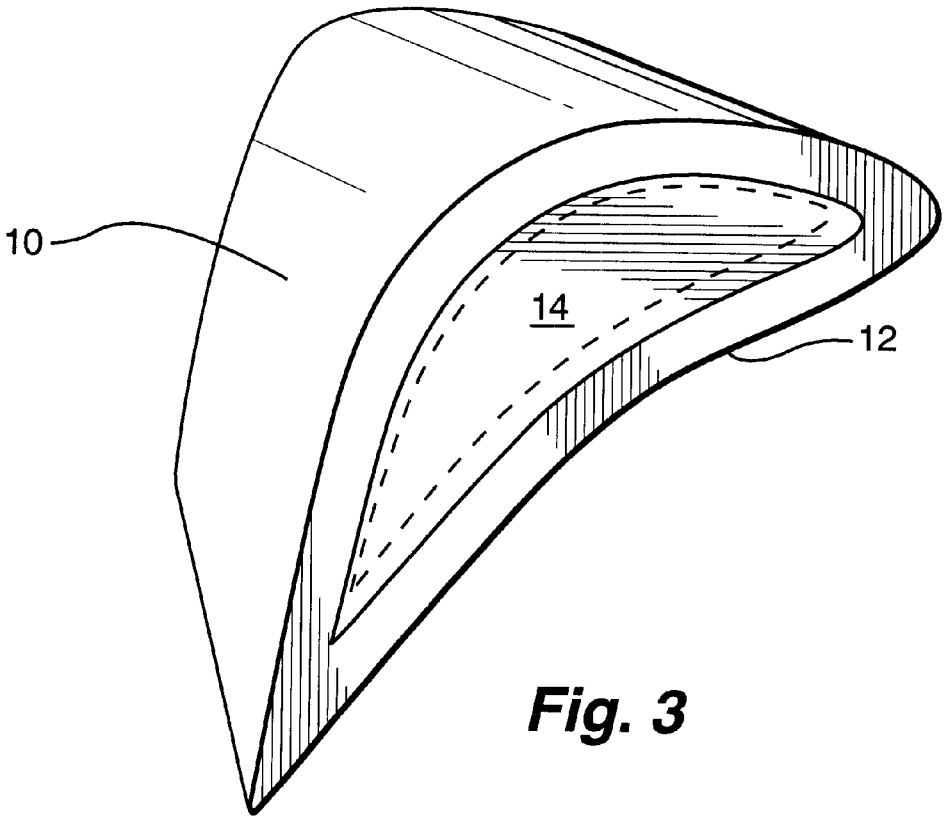
FIG. 3 shows a material filling in the exterior recessed portion of the end cap shown in FIG. 2.

There are many possible variations on this invention. For instance, as shown in FIG. 3, an epoxy, gasket or any other suitable type of water resistant material, can be used to fill in at least part of the interior cavity, after the recessed end cap 14 has been applied, to provide an additional moisture barrier. The depth of end cap 14 serves to escape the high, localized temperatures due to welding the partition to the inner or outer ring. This moisture barrier could also be created mechanically, such as by a press-fit end cap.

Another instance of this invention would be to fill the partition with high temperature-resistant synthetic or natural material, thereby preventing moisture and subsequent contamination from being either absorbed by the material or from leaking into and residing within the hollow cavity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A hollow nozzle partition having a first plate with a convex surface and a second plate with a concave surface, said first and second plates being welded together, said partition further comprising at least one recessed end cap attached to at least one end of said partition to close off an opening to said partition, wherein a space adjacent to said at least one recessed end cap, within said partition, is at least partially filled in by moisture resistant material.

2. The partition of claim 1, said moisture resistant material being epoxy.

3. The partition of claim 2, further comprising filling the partition with high temperature resistant material.

4. The partition of claim 1, further comprising filling the partition with high temperature resistant material.

5. The partition of claim 1, wherein two of said recessed end caps are attached at opposite ends of said partition to close off all openings to said partition.

6. The partition of claim 1, wherein said recessed cap is welded to said partition.

7. The partition of claim 1, wherein said recessed cap is bonded to said partition.

8. A hollow nozzle partition having a first plate with a convex surface and a second plate with a concave surface, said first and second plates being welded together, said partition further comprising at least one recessed end cap attached to at least one end of said partition to close off an opening to said partition, and a gasket disposed within a space adjacent to said at least one recessed end cap, within said partition.

9. The partition of claim 8, further comprising filling the partition with high temperature resistant material.

10. The partition of claim 8, wherein two of said recessed end caps are attached at opposite ends of said partition to close off all openings to said partition.

11. The partition of claim 8, wherein said recessed cap is welded to said partition.

12. The partition of claim 8, wherein said recessed cap is bonded to said partition.

13. A hollow nozzle partition having a first plate with a convex surface and a second plate with a concave surface, said first and second plates being welded together, said partition further comprising at least one recessed end cap attached to at least one end of said partition to close off an opening to said partition, and said partition being filled with high temperature resistant material.

14. The partition of claim 13, wherein two of said recessed end caps are attached at opposite ends of said partition to close off all openings to said partition.

15. The partition of claim 13, wherein said recessed cap is welded to said partition.

16. The partition of claim 13, wherein said recessed cap is bonded to said partition.

* * * * *